US006415826B1

(12) United States Patent
DellaVecchia

(10) Patent No.: US 6,415,826 B1
(45) Date of Patent: Jul. 9, 2002

(54) APPARATUS FOR INSERTING MORTAR IN MASONRY CONSTRUCTION

(76) Inventor: Michael A. DellaVecchia, 138 Church St., Wallingford, CT (US) 06492

( * ) Notice: Subject to any disclaimer, the term of this patent is extended or adjusted under 35 U.S.C. 154(b) by 0 days.

(21) Appl. No.: 09/884,835

(22) Filed: Jun. 19, 2001

(51) Int. Cl.[7] ..... B67B 3/26

(52) U.S. Cl. ..... 141/263; 141/331; 141/340; 141/391

(58) Field of Search ..... 141/263, 331, 141/332, 333, 334, 335, 339, 340, 343, 391; 52/DIG. 1, 742.13, 742.14, 742.16, 749.13; 222/386

(56) References Cited

U.S. PATENT DOCUMENTS 2,578,765 A * 12/1951 Wallace
2,761,305 A * 9/1956 Davis
2,955,627 A * 10/1960 Gaskins
3,227,161 A * 1/1966 De Lorenzo
3,315,847 A * 4/1967 Trumbull
3,371,459 A * 3/1968 Thomas et al.
3,764,222 A 10/1973 Orthman
3,999,920 A 12/1976 Cerillo, Jr.
4,311,258 A 1/1982 Bradshaw
4,382,720 A * 5/1983 Vonach
4,509,884 A * 4/1985 Trout et al.
4,792,066 A * 12/1988 Kobayashi
4,852,772 A 8/1989 Ennis, III
5,027,568 A * 7/1991 Schmidt
5,111,973 A 5/1992 Mueller
5,114,040 A 5/1992 Brenish et al.
5,155,965 A * 10/1992 Tabei et al.
5,158,214 A 10/1992 Volpe et al.
5,246,144 A 9/1993 Cathcart, Sr. et al.
5,385,274 A 1/1995 Twyman
5,476,344 A * 12/1995 Nordvall
5,681,125 A 10/1997 Amaya
5,695,560 A 12/1997 Hession
5,809,736 A * 9/1998 Naito et al.
5,868,180 A * 2/1999 Hendrickson
5,881,523 A * 3/1999 Quatrochi, Jr.
5,996,856 A 12/1999 Duncan
6,152,332 A * 11/2000 Funk
6,226,948 B1 * 5/2001 Trout

* cited by examiner

*Primary Examiner*—Gregory Huson
*Assistant Examiner*—Khoa D. Huynh
(74) *Attorney, Agent, or Firm*—Robert A. Seemann

(57) ABSTRACT

A container that is filled from one end with mortar includes a flexible tube at the other end that is elongated in cross section and open at one end. A shoulder on the container is spaced from the opening about the distance of the height of an opening between facing surfaces of adjacent masonry units that is to be filled with the mortar.

2 Claims, 6 Drawing Sheets

APPARATUS FOR INSERTING MORTAR IN MASONRY CONSTRUCTION

BACKGROUND OF THE INVENTION

1. Field of the Invention

This invention pertains to application of mortar between the vertical walls of adjacent building block elements, more specifically to a tool for experienced and inexperienced workers to accurately, repeatedly, place the correct amount of mortaring cement between facing sides of adjacent blocks in construction of a wall. With the tool, blocks can be placed in a horizontal line accurately, eliminating the need to set blocks vertically and horizontally at the same time. It can be used to horizontally fill the space where a wall abuts a header, and also against an adjacent wall.

2. Description of the Prior Art

The prior art is replete with patented apparatus for applying mortar to a course of adjacent building block elements.

U.S. Pat. No. 3,764,222 patented Oct. 9, 1973 by Orthman describes a box having a bottom opening that is about as wide as a brick. A pair of guide rails on the bottom of the box are designed to guide the box for lengthwise movement along the top of a wall. A slide-out plate seals the bottom of the box. The box is filled with mortar and the plate is slid out so that the mortar is deposited on and between adjacent bricks as the box is pulled along the wall. The trailing end of the box has a liftable gate which can be set at a desired height above the bricks to control the thickness of the layer of mortar that is left behind on the top of the bricks as the box is pulled forward. Alignment members extend downward from the sides of the box so that they hug the side of the wall being built to align the box vertically and scrape the mortar overflowing to the side of the wall.

U.S. Pat. No. 3,999,920 patented Dec. 28, 1976 by Cerillo, Jr., describes a container that is positioned over the space between two adjacent bricks in a course of bricks such as on the top of a wall under construction. In the bottom of the container, positioned over the opening, is a slot that is wider than, and almost as long as, the opening between the bricks. The slot is temporarily sealed by a slide gate. Vertical bars extending downward from opposite sides of the box seal the vertical open ends of the space between the bricks. The gate is open allowing the mortar to enter the space between the bricks until the space is filled, then the gate is closed. The container is then lifted straight up from the filled space between the bricks and slid down over another empty space between bricks of the course, aligned with the space by the vertical bars which each present a convex surface toward the opening.

U.S. Pat. No. 4,311,258 patented Jan. 19, 1982 by P. Bradshaw describes a cylindrical barrel having at the front end of the barrel, a cap formed into a tubular stalk outlet cut on a bias. A plunger sealingly slides within the tube, operated by a ratchet trigger mechanism to force mortar from within the tube, out of the tube through the stalk. The tube is refilled by removing the cap and drawing the mortar into the tube by pulling the plunger in the tube toward the back end of the tube.

U.S. Pat. No. 5,114,040 patented May 19, 1992 by Brenish et al. describes a hopper having horizontally elongated, angled downward and inward, side walls which terminate in a longitudinal slot opening at the bottom of the hopper. A pair of parallel guide strips, open downward and at their ends, extend downward from the slot the length of the slot. The hopper is supported a fixed height by skids on spaced adjacent paving stones so that the guide strips extend into the space between the stones. A plunger consisting of a horizontal bar having sides of the lower half of the bar angled downward and inward at the same angle as the side walls, terminating in a flat bottom, and the sides of the upper half angled upward and inward, is held in the hopper parallel to the slot by a vertical handle, and reciprocated up and down in the cement filled hopper so that the cement is mixed and dispensed through the slot. When the bar comes in contact with the side walls of the hopper it seals the opening, and the hopper can be moved further along the space between the paving stones.

U.S. Pat. No. 5,695,560 patented Dec. 9, 1997 by R. Hession describes a hopper having two parallel exit slots, spaced apart so that each slot lays a ribbon of mortar along one edge of the top of a row of bricks as the hopper rolls along the top of the row of bricks supported by plurality of wheels riding on the bricks between the slots, and guided laterally by outboard vertically axled wheels bearing on the opposite sides of the bricks below the top of the bricks.

U.S. Pat. No. 5,996,856, patented by J. Duncan on Dec. 7, 1999 describes a container that contains a worm gear driven by an electric motor to force mortar in the container from the container into a tube having a clamp and a tube spreader assembly mounted on the end of the tube. The container is mounted on an arm that is mounted on a track follower assembly.

SUMMARY OF THE INVENTION

It is one object of the invention to provide a hand tool for applying masonry binder or filler material between adjacent masonry units in a masonry construction. It is another object of the invention that the tool extends into the space between the adjacent masonry units to the surface upon which the masonry units rest. It is another object that the binder material is added to the space as the tool is moved out of the space away from the surface upon which the masonry units rest. Other objects and advantages will become apparent to one reading the ensuing description of the invention.

A container includes a flexible tube that is elongated in cross section. The tube is at least as long as a first length of a first facing surface of adjacent, facing, spaced apart surfaces of adjacent masonry units. An opening in the tube is shorter in the elongated direction than a second length of the first facing surface normal to the first length of the first facing surface.

Another tool of the invention for inserting mortar between a first surface having a height and a width of a first masonry unit, and a second surface of a second masonry unit adjacent to, facing and spaced from the first surface, includes a container that includes a flexible elongated in cross section tube, a first opening at a first end of the tube being shorter in the elongated direction than the width of the first face unit and spaced from a shoulder on said tool a distance no longer than the height of the first masonry unit, and a second opening in the container configured for receiving mortar for passing mortar through said tube to the first opening.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
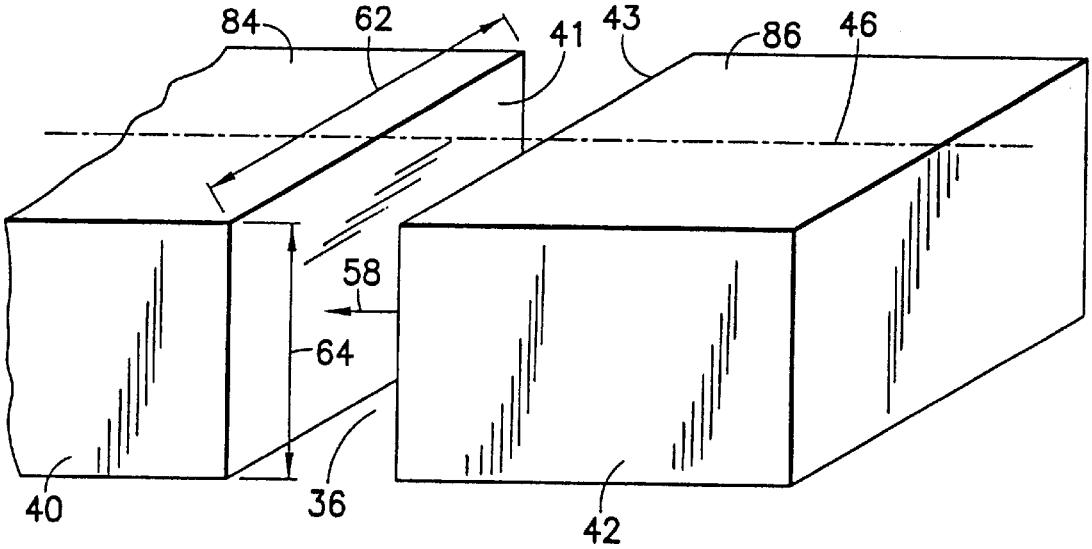
FIG. 1 is a perspective view of adjacent brick masonry units.
Figure 2:
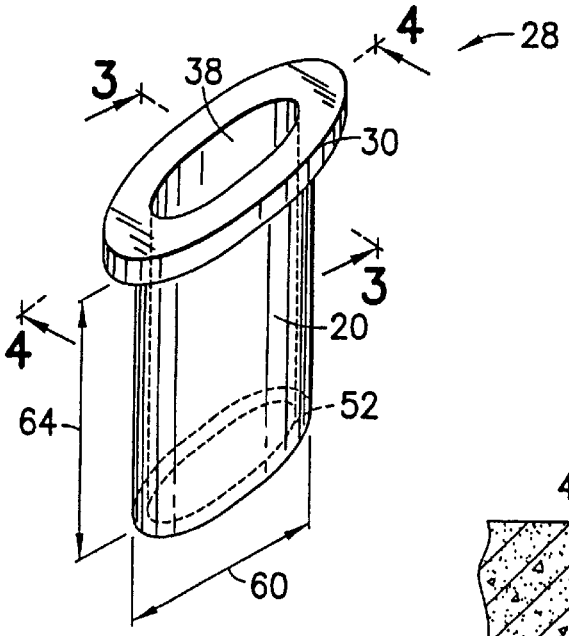
FIG. 2 is a perspective view of a delivery element of the invention.
Figure 3:
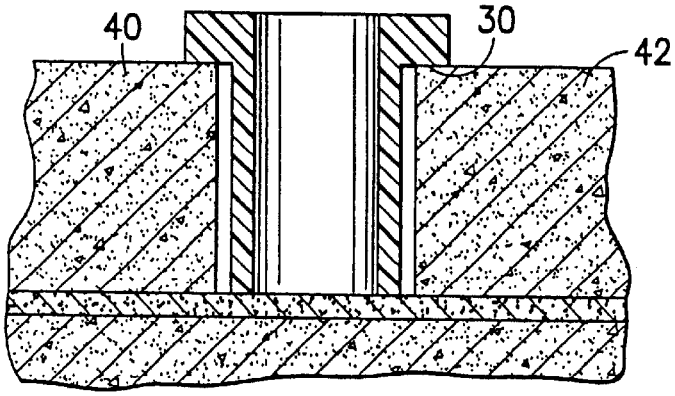
FIG. 3 is a cross section view of the delivery element of FIG. 2 taken along 3—3, in the space between the bricks of FIG. 1, resting on a layer of mortar on another brick of a wall.
Figure 4:
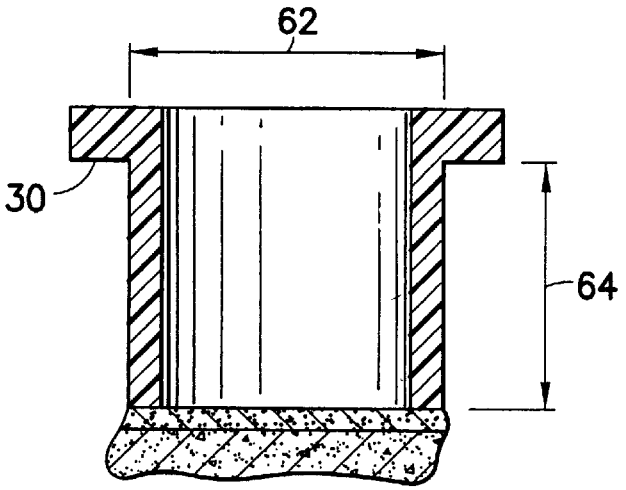
FIG. 4 is a cross section view of the delivery element of FIG. 2 taken along 4—4 in the space between the bricks of FIG. 1, resting on a layer of mortar on another brick of a wall as in FIG. 3.
Figure 5:
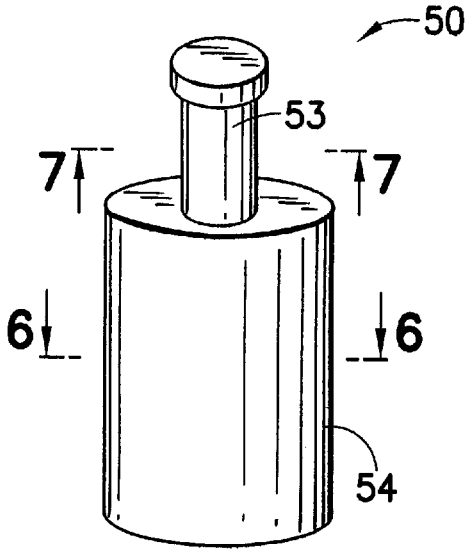
FIG. 5 is a perspective view of a hand piston of the invention.
Figure 6:
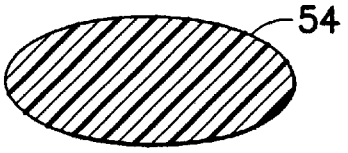
FIG. 6 is a cross section view of the piston of FIG. 5 taken along 6—6.
Figure 7:
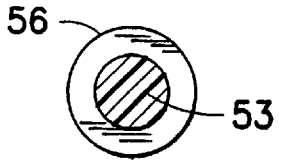
FIG. 7 is a cross section view of the piston of FIG. 5 taken along 7—7.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

The term "mortar" used herein in the specification and in the claims is herein defined to mean masonry binder material or mansonary filler material, which includes but is not limited to mortar and cement.

Referring to FIGS. 1–7, flexible oval tube 20 of delivery element 28 is attached to radially extending shoulder 30. Preferably the shoulder is molded as one with the tube.

Tube 20 may be made about as long 60 as the length 62 of space 36. Length 62 is the same as, and parallels the width of brick 40. Tube 20 may be made as high 64 as space 36, and element 28 can be inserted to the bottom of the space to the surface upon which bricks 40, 42 rest and then gradually drawn up as the mortar is forced out of the tube by gravity or by piston 50.

The tube is inserted, preferably from the top, into vertical slot space 36 between bricks 40, 42 at about centerline 46. Shoulder 30 rests on tops 84, 86 of the bricks.

Figure 13:
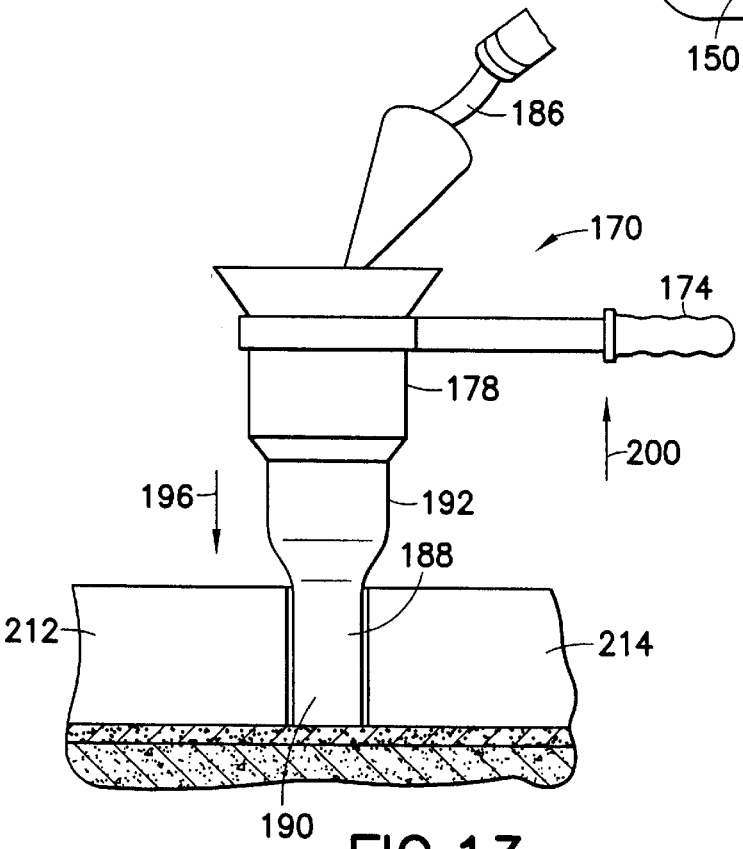
FIG. 13 is a schematic view of another delivery element of the invention being filled with a trowel as the delivery element is in contact with a layer of cement on the top of a wall
Figure 14:
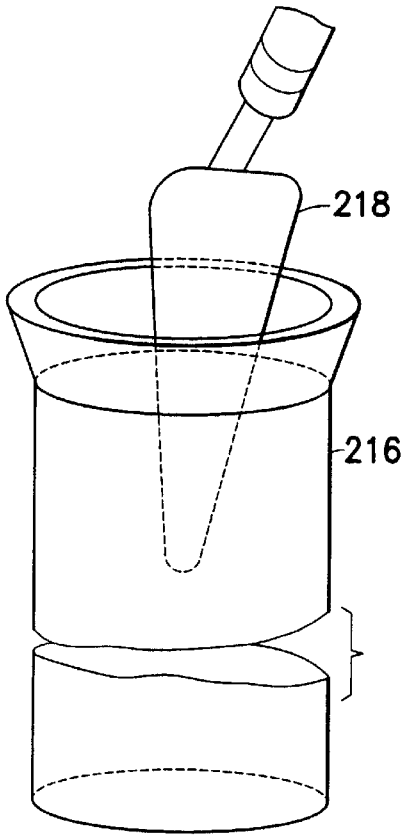
FIG. 14 is a perspective view of another delivery element of the invention receiving a trowel.

A sufficient amount of mortar is loaded into the tube by way of opening 38 preferably to fill to the top 86 at least one of bricks 40, 42. FIGS. 13 and 14 show delivery elements of the invention being filled by a trowel. Other filler tools can be used.

The tube is raised or lifted up to allow the mortar to exit the tube by way of opening 52.

The bricks can be left in their just filled position. This fills slot space 36 completely across the facing surfaces 41, 43 of the bricks.

Less mortar can be loaded into the tube, and the bricks are then pushed together after the tube is raised from the space between the bricks, but can be pushed together while the tube is being raised. They can be pushed together 58 to move the mortar evenly over each of the adjacent brick surfaces.

A piston may be used. Hand piston 50 oval end 54 closely fits opening 38. The piston is pushed down by handle 53 into the tube so that the piston forces the measured amount of mortar into the vertical slot space. Enlarged tip 56 keeps the hand form slipping off the handle when the piston is withdrawn from the tube.

Figure 8:
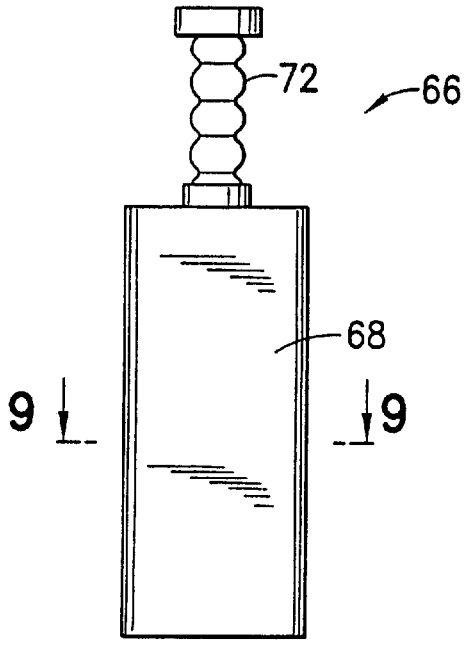
FIG. 8 is another piston of the invention.
Figure 9:
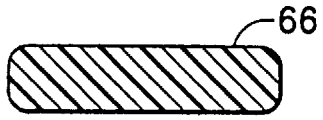
FIG. 9 is a cross section view of the piston of FIG. 8 taken along 9—9.
Figure 16:
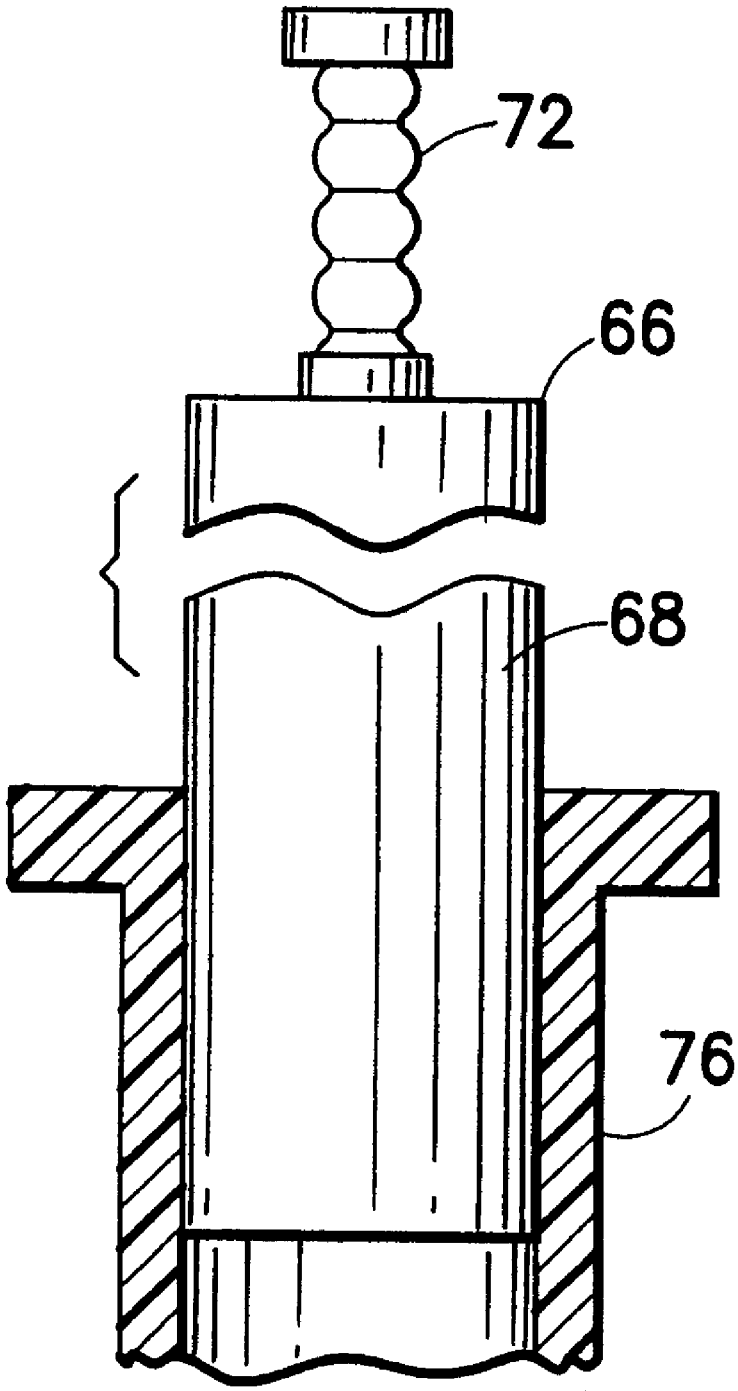
FIG. 16 is a view of the piston of FIG. 8 and a flexible tube.

In FIGS. 8, 9, and 16, hand piston paddle section 68 of piston 66 is used to push mortar into a narrow space such as a horizontal space between a top building block and a ceiling. The paddle is operated by handle 72. Piston 66 is molded in one piece of a flexible plastic. The flexible tube 76 containing the piston and conforming to the shape of the piston can be inserted into the space next to a ceiling or wall by a hand on handle 72 without the wall interfering with the hand, by flexing the handle portion of the piston away from the wall.

Figure 10:
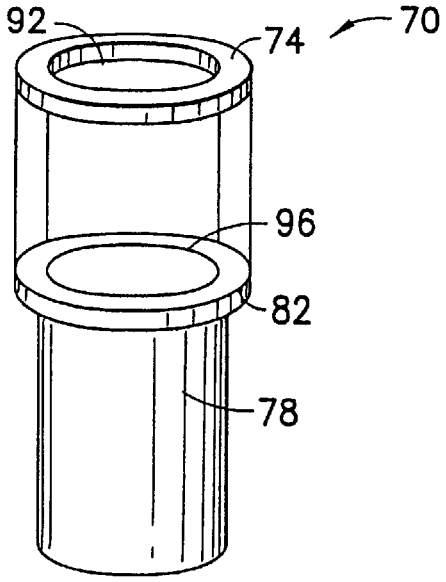
FIG. 10 is a schematic view of another delivery element of the invention.

In FIG. 10, delivery element 70 is held by ring 74 as flexible tube 78 is inserted onto vertical slot space 36 until shoulder 82 rests on tops 84, 86 of bricks 40, 42. Then mortar is delivered into the space by the tube as piston 50 is pushed down through openings 92, 96 and tube 78.

The invention can also be used to deliver mortar horizontally into vertical slot space 36 by laying tube 78 sideways in opening 36 and drawing the delivery element out sideways as the mortar is delivered into the space as the piston is pushed through openings 92, 96 and tube 78.

Figure 11:
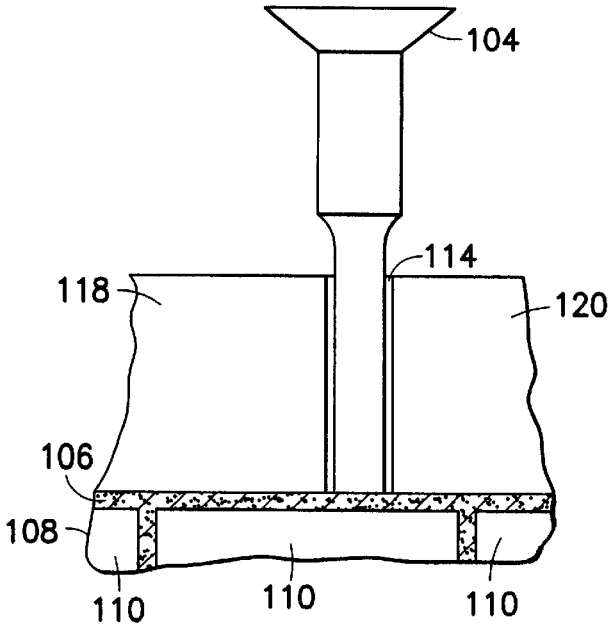
FIG. 11 is a schematic view of another delivery element of the invention in a space between bricks, resting on a layer of mortar on another brick of a wall.

In FIG. 11, delivery element 104 is resting on mortar 106 that is on top of row 108 of bricks 110, and in the space 114 between cap stones 118 and 120.

Figure 12:
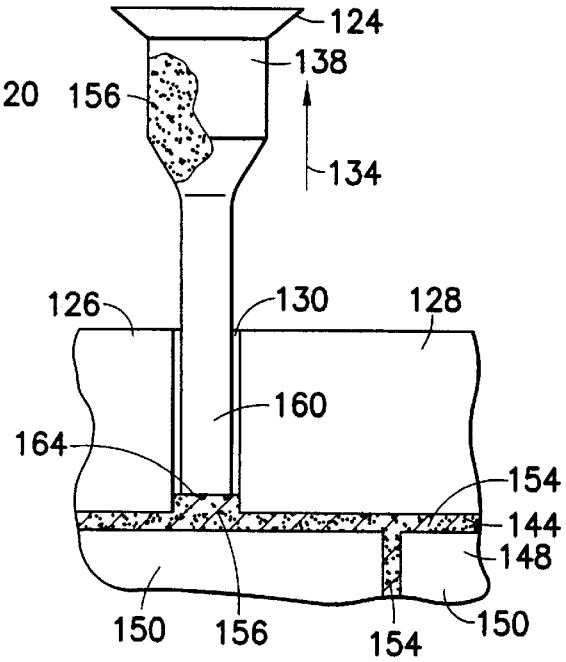
FIG. 12 is a schematic view of another delivery element of the invention in a space A between bricks, being moved away from a layer of mortar on another brick of a wall.

In FIG. 12, delivery element 124 which has been filled up through enlarged portion 138 with a quantity of mortar 156 is in space 130 between cap stones 126, 128. Element 124 is being removed 134 from layer 144 of mortar 154 that is on top row 148 of wall stones 150. As delivery element 124 is removed, mortar 156 exits tube 160 at opening 164. Tube 160 of delivery element 124 is stiff. Stones 150 are either left permanently with space 130 filled with mortar, or they may be moved closer together after tube 160 is moved out of the space.

In FIG. 13, delivery element 170 is held by movable and removable handle 174 as mortar is loaded into large upper portion 178 by tool 186. The mortar moves by gravity into flexible tube 192. Portion 188 of tube 192 that is between bricks 212, 214, is pinched to a smaller diameter than the upper portion of tube 192 of the tube as the bricks moved closer together after the tube is inserted 196 between the bricks. When the tube is lifted 200 from the space between the bricks, the tube leaves mortar in the space between the bricks. Delivery element 170 can be supplied with tube 192 of a larger length than either the height or width of standard bricks or of cap stones. The tube is cut in the field to suit the height or width of the space to be encountered and the direction at which the tube is to be inserted into and withdrawn from the space.

In FIG. 14 element 216 is receiving spade 218.

Figure 15:
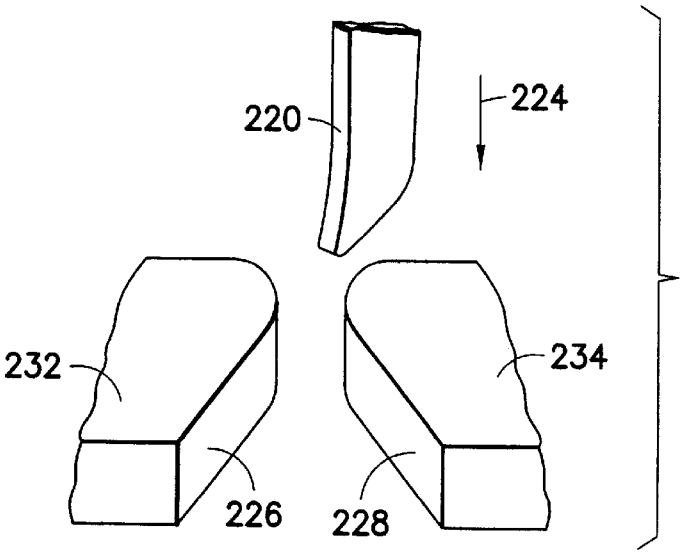
FIG. 15 is a perspective view of the tube of a delivery element positioned for moving between facing surfaces of adjacent paving stone masonry units.

In FIG. 15 flexible tube 220 of a delivery unit of the invention is positioned for insertion 224 between adjacent facing surfaces 226, 228 of paving stone masonry units 232, 234.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

Drawing Designators (Informal List)

20 flexible tube
28 delivery element
30 shoulder
36 vertical slot space
38 opening
40 brick
41 facing surface
42 brick
43 facing surface
46 centerline
F 50 piston, hand
52 opening
53 handle
54 oval end
56 enlarged tip
58 direction arrow, pushed together
60 length, arrow
62 length of space 36
64 height, arrow
66 piston
68 section of piston 66
70 delivery element
72 handle
74 ring
76 flexible tube
78 tube
82 shoulder
84 top of brick
86 top of brick
92 opening
96 opening
104 delivery element
106 mortar
108 top row
110 brick
114 space
118 cap stone
120 cap stone
124 delivery element
126 cap stone
128 cap stone
130 space
134 removed, direction arrow
138 enlarged portion
144 layer of mortar
148 top row
150 wall stone
154 mortar
156 mortar
160 tube
170 delivery element
174 handle
178 larger upper portion
186 tool
188 portion of tube 190
192 tube, flexible
196 inserted, direction arrow
200 lifted, direction arrow
212 brick
214 brick
216 delivery element
218 spade
220 flexible tube
224 insertion, direction arrow
226 facing surface
228 facing surface
232 paving stone
234 paving stone

What is claimed is:

1. A method for inserting mortar between adjacent facing spaced apart first and second surfaces respectively of a first masonry unit and a second masonry unit in a masonry construction comprising the steps of:

loading the mortar into a container comprising an elongated in cross section flexible tube being at least as long as a length of the first surface, said tube having an opening at a first end, positioning the tube into the space between the first and second surfaces, placing mortar into a second opening of the tube, applying pressure on the mortar with an elongated in cross section hand-held piston extending into and closely fitting the tube over a length of the piston in the tube, withdrawing the tube from the space between the surfaces during movement of the mortar out of the opening in the first end, and moving the masonry units towards one another so that it reduces the space between the surfaces and changes the cross sectional shape of the tube while the surfaces are in contact with the tube.

2. A method for inserting mortar between adjacent facing spaced apart first and second surfaces respectively of a first masonry unit and a second masonry unit in a masonry construction comprising the steps of:

loading the mortar into a container comprising an elongated in cross section flexible tube being at least as long as a length of the first surface, said tube having an opening at a first end, positioning the tube into the space between the first and second surfaces, placing mortar into a second opening of the tube, applying pressure on the mortar with an elongated in cross section hand-held piston extending into and closely fitting the tube over a length of the piston in the tube, withdrawing the tube from the space between the surfaces during movement of the mortar out of the opening in the first end, and moving the masonry units towards one another so that it reduces the space between the surfaces, reducing the diameter of the tube while the surfaces are in contact with the tube.

* * * * *